US005664672A

United States Patent [19]

Niksich

[11] Patent Number: 5,664,672

[45] Date of Patent: Sep. 9, 1997

[54] CLOSURE MECHANISM FOR A CONTAINER THAT HOLDS TENNIS BALLS

[75] Inventor: Gene Niksich, Alpharetta, Ga.

[73] Assignee: Unique Sports Products, Inc., Alpharetta, Ga.

[21] Appl. No.: 656,905

[22] Filed: Jun. 3, 1996

[51] Int. Cl.[6] ..... B65D 85/00

[52] U.S. Cl. ..... 206/315.9; 294/19.2

[58] Field of Search ..... 206/315.9, 575, 206/1.5; 294/19.2; 221/255, 268, 306; 222/544, 545, 559

[56] References Cited

U.S. PATENT DOCUMENTS

| | | | |
|---|---|---|---|
| 3,984,138 | 10/1976 | Brunner et al. | 294/19 |
| 4,412,697 | 11/1983 | Verde | 294/19 |
| 4,461,504 | 7/1984 | Perez et al. | 294/19 |
| 4,811,980 | 3/1989 | Ferrari et al. | 294/19 |
| 4,844,527 | 7/1989 | Ray | 294/19 |
| 5,294,161 | 3/1994 | Stap | 294/19.2 |

*Primary Examiner*—David T. Fidei
*Attorney, Agent, or Firm*—Norman B. Rainer

[57] ABSTRACT

A closure mechanism for the top of a tennis ball storage container employs a pair of barrier rods that are slideably engaged by tracks in the end panels of the container. When the rods are squeezed together, they enter snap-fitting holding pockets located at the innermost extremities of the tracks. When secured by the holding pockets, the distance of separation between the parallel rods is less than the diameter of a standard tennis ball. When the rods are manipulated apart away from the holding pockets, their distance of separation becomes large enough to permit removal of balls from the container.

5 Claims, 2 Drawing Sheets

CLOSURE MECHANISM FOR A CONTAINER THAT HOLDS TENNIS BALLS

BACKGROUND OF THE INVENTION

1. Field of the Invention

This invention concerns a closure mechanism for preventing inadvertent release of tennis balls from a storage container.

2. Description of the Prior Art

Tennis players often utilize a considerable number of tennis balls during practice sessions, especially in the repetitive hitting of tennis balls delivered by an instructor or practice machine. Specialized storage containers have been disclosed for use in collecting and storing the balls while on the tennis court and for transporting the balls to and from the tennis court.

For example, U.S. Pat. Nos. 3,371,950 and 5,294,161 to Stap concern a box-like container which enables the player to retrieve balls on the ground without bending over. The mechanism of ball retrieval involves a pair of parallel rods located on the bottom of the container, and spaced apart a distance slightly less than the standard diameter of a tennis ball. The ball is retrieved by positioning the container above the ball, and pressing downwardly, causing the ball to squeeze between the rods and thereby enter upwardly into the container. Balls can be removed from the top of the container by first removing a closure lid.

In the manufacture of products of relatively low cost, shipping charges become a significant factor in the economic viability of the product. The box-like tennis ball retrieval/storage container of Stap's design, if shipped in its fully assembled state, would occupy considerable space and thereby incur substantial freight charges. Accordingly, the container is fabricated in a manner such that the component parts can be compactly packaged for assembly by the purchaser. In particular, Stap's container is comprised of four side panels and a removable lid panel, all of molded plastic construction, which can be compactly stacked for packaging. The two ball-receiving rods which constitute the bottom extremity of the container are inserted into mating receiving sockets during assembly of the container.

Since tennis ball storage/retriever units are carried and manipulated by the player during extensive periods of use, it is desirable that the unit be of minimal weight. In those instances where the ball storage/retriever unit contains a closure lid, the lid not only adds weight to the unit but obscures the player's vision of the entrance rods on the bottom of the container. The lid, when of removable construction, represents a component apt to become lost during use. From a manufacturing standpoint, the lid, which represents one of the five confining panels of the container, constitutes a significant proportion of the overall amount of plastic material required for fabrication.

It is accordingly an object of the present invention to provide a closure mechanism for a container that holds tennis balls.

It is another object of this invention to provide a closure mechanism as in the foregoing object which contributes very little weight to the container.

It is still another object of the present invention to provide a closure mechanism of the aforesaid nature which does not obscure vision of the interior of the container.

It is a further object of this invention to provide a closure mechanism of the aforesaid nature which is non-separable from the container.

It is yet another object of the present invention to provide a closure mechanism of the aforesaid nature which is easy to use and of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a closure mechanism for a tennis ball storage container of rectangular box like shape defined by paired side panels and opposed first and second end panels, said container further having a bottom extremity that admits balls and a top extremity which permits removal of balls, said closure mechanism comprising:

a) a first pair of left and right straight guide tracks disposed in linear alignment in said first end panel adjacent the top extremity thereof, each track terminating in a squeeze-activated holding pocket directed toward the interior of the container in facing relationship and separated by a distance slightly less than the diameter of a tennis ball, b) a second pair of straight left and right guide tracks disposed in linear alignment in said second end panel adjacent the top extremity thereof and in coplanar relationship with said first pair of guide tracks, each guide track terminating in a squeeze-activated holding pocket directed toward the interior of the container in facing relationship and separated by a distance slightly less than the diameter of a tennis ball, c) a left barrier rod of straight construction terminating in ends that are slidably retained by the left guide tracks of said first and second pairs of guide tracks and configured to snap-fit into the respective holding pockets of said guide tracks, and d) a right barrier rod of straight construction terminating in ends that are slidably retained by the right guide tracks of said first and second pairs of guide tracks and configured to snap-fit into the respective holding pockets of said guide tracks, whereby e) when said left and right barrier rods are manipulated to their position of closest approach, the rods become secured by engagement with said holding pockets, and in said closest approach position said rods are parallel and spaced apart by a distance which prevents inadvertent passage of a tennis ball, and f) when said barrier rods are moved apart by sliding movement away from said holding pockets, their spacing is such as to permit easy removal of tennis balls from the container.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

The terms "inner", "outer", "exterior", "interior" and expressions of similar import have reference to the internal region of the container.

DESCRIPTION OF THE PREFERRED EMBODIMENT

Figure 1:
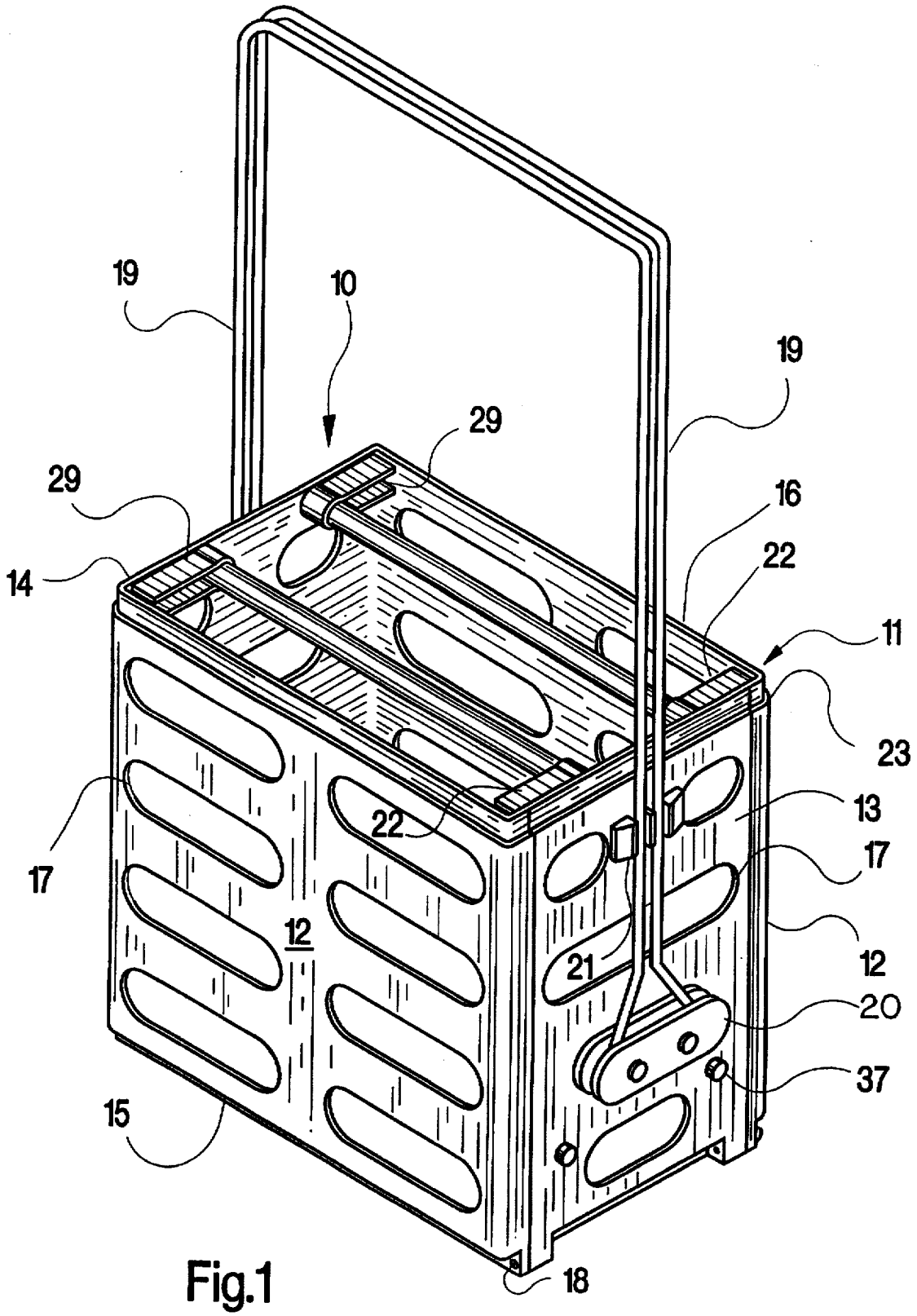
FIG. 1 is a top perspective view of an embodiment of the closure mechanism of the present invention shown in operative association with a container for retrieving and storing tennis balls.

Referring now to FIG. 1, an embodiment of the closure mechanism 10 of the present invention is shown in functional relationship with the top extremity 16 of a tennis ball retrieval and storage container 11.

Said storage container is of rectangular box-like shape defined by paired side panels 12 and opposed first and second end panels 13 and 14, respectively. The bottom extremity 15 is equipped with spaced apart bars that squeezingly admit tennis balls upwardly into the container. Said side and end panels are provided with slotted apertures 17 which improve the visibility of balls within the container. The end panels are joined to the side panels by user-serviceable fastening means such as screws 18.

Elongated paired handles 19 are attached by pivot means 20 to said end panels in a manner such that, in their upright position, as shown in FIG. 1, the player can carry the container by the handles and push down upon the container to force balls on the ground up into the container. The handles are secured in their upright position by upper locking means 21. The handles may also be swung into a downwardly and outwardly directed position and secured by paired abutment tabs 37. In said downward position, the handles form a stand that can support the container in self-standing position to a convenient height for the player to remove balls from the top of the container.

Figure 2:
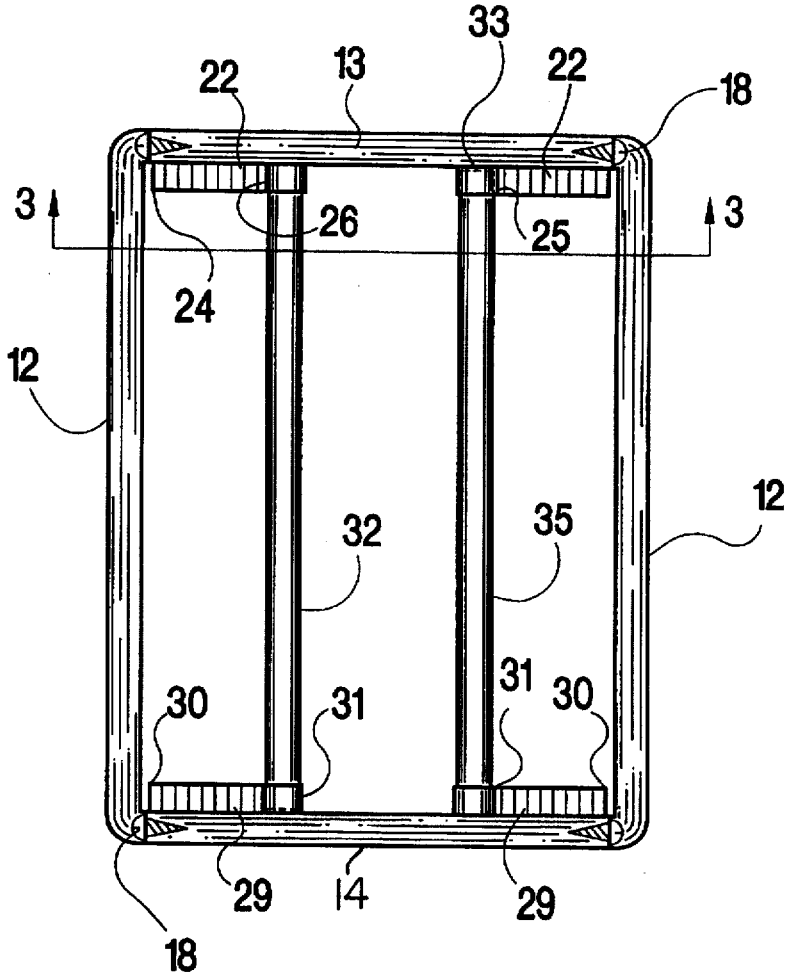
FIG. 2 is an enlarged top plan view of the closure mechanism of FIG. 1.
Figure 3:
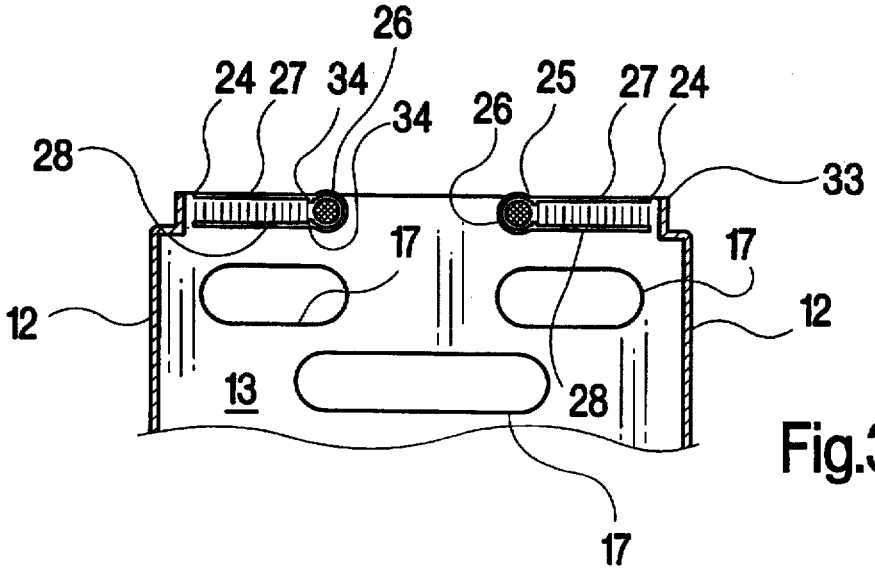
FIG. 3 is a fragmentary sectional view taken in the direction of the arrows upon the line 3—3 of FIG. 2.

Closure mechanism 10, as further illustrated in FIGS. 2 and 3, is comprised of a first pair of left and right straight guide tracks 22 disposed in linear alignment in first end panel 13 adjacent top extremity 16. Said tracks are comprised of parallel upper and lower retainer strips 27 and 28, respectively, orthogonally emergent from end panel 13. Said strips extend along wall 13 between an outwardly directed extremity 24 and closed inwardly directed extremity 25 configured as a squeeze-activated circular holding pocket 26. The holding pockets of said first pair of tracks are directed toward the interior of the container in facing relationship and separated by a distance slightly less than the diameter of a tennis ball. Likewise, the distance between said holding pockets and the corresponding side panel 12 is less than the diameter of a tennis ball.

A second pair of left and right straight guide tracks 29 is disposed in linear alignment in said second end panel 14 adjacent top extremity 16 thereof and in coplanar relationship with said first pair of guide tracks. The plane of said tracks is orthogonal to said end panels, and parallel to the bottom of the container. Said second tracks 29 are of identical construction to said first tracks 22, terminating in outwardly directed extremities 30 and interiorly directed holding pockets 31. The four holding pockets of the two pairs of left and right tracks define a rectangular locus.

A left barrier rod 32 of straight construction terminates in ends 33 that are slidably retained by the left guide tracks of said first and second pairs of guide tracks, 22 and 29, respectively. Barrier rod 32 is configured to snap-fit into the respective holding pockets 26 and 31 of said guide tracks. The snap-fitting effect is produced by opposed raised protrusions such as tabs 34 which extend less than a millimeter from strips 27 and 28 as continuous integral extensions thereof. The nature of the sliding retention of rod 32 by said left guide tracks is that the rod can be easily manipulated into and out of the locking securement provided by the respective pockets.

A right barrier rod 35 of straight construction terminates in ends 33 that are slidably retained by the right guide tracks of said first and second pairs of guide tracks. The right barrier rod is identical in construction and functionality to the aforesaid left barrier rod 32.

The track members of the closure mechanism of the present invention are essentially continuous integral extensions of the end panels of the tennis ball container. Accordingly, they are fabricated of the same plastic material employed in fabricating the tennis ball container. Suitable plastic materials include polyethylene, polypropylene, acrylonitrile/butadiene/styrene terpolymer, generally known as ABS plastic, and equivalent plastics that provide good durability, light weight and low cost. The barrier rods may be fabricated of rigid polymer material or metal such as aluminum, or fiberglass, wood, or equivalent rigid material.

The barrier rods are inserted into their respective opposite tracks during assembly of the ball container, said assembly involving the interengagement of the several panels with screws 18 or other fastener means. Once the container is assembled, the barrier rods are secured within their tracks.

In use, when it is desired to prevent the inadvertent release of balls from the container, the two barrier rods are squeezed together so that they snap-fit into their respective holding pockets. In this state, the spacing between the two barrier rods, and the spacing between either barrier rod and the corresponding sidewall 12 is too small to permit egress of a tennis ball. When either or both barrier rods are forced outwardly from their holding pockets towards their respective sidewall, an opening is created between the two barrier rods to permit easy removal of tennis balls.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A closure mechanism for a tennis ball storage container of rectangular box shape defined by paired side panels and opposed first and second end panels, said container further having a bottom extremity that admits balls and a top extremity which permits removal of balls, said closure mechanism comprising:

a) a first pair of left and right straight guide tracks disposed in linear alignment in said first end panel adjacent the top extremity thereof, each track terminating in a squeeze-activated holding pocket directed toward the interior of the container in facing relationship and separated by a distance slightly less than the diameter of a tennis ball, b) a second pair of straight left and right guide tracks disposed in linear alignment in said second end panel adjacent the top extremity thereof and in coplanar relationship with said first pair of guide tracks, each guide track terminating in a squeeze-activated holding pocket directed toward the interior of the container in facing relationship and separated by a distance slightly less than the diameter of a tennis ball, c) a left barrier rod of straight construction terminating in ends that are slidably retained by the left guide tracks of said first and second pairs of guide tracks and configured to snap-fit into the respective holding pockets of said guide tracks, and d) a right barrier rod of straight construction terminating in ends that are slidably retained by the right guide tracks of said first and second pairs of guide tracks and configured to snap-fit into the respective holding pockets of said guide tracks, whereby e) when said left and right barrier rods are manipulated to their position of closest approach, the rods become secured by engagement with said holding pockets, and in said closest approach position said rods are parallel and spaced apart by a distance which prevents inadvertent passage of a tennis ball, and f) when said barrier rods are moved apart by sliding movement away from said holding pockets, their spacing is such as to permit easy removal of tennis balls from the container.

2. The closure mechanism of claim 1 wherein said first and second pairs of guide tracks are continuous integral extensions of said respective end panels.

3. The closure mechanism of claim 1 wherein said end and side panels are interengaged by way of user-serviceable fastening means.

4. The closure mechanism of claim 1 wherein opposed raised protrusions of less than a millimeter height are associated with each holding pocket to permit snap-fitting interaction with said barrier rods.

5. A tennis ball storage container of rectangular box shape defined by paired side panels, opposed first and second end panels, a bottom extremity that admits balls, a top extremity which permits removal of balls, and a closure mechanism of claim 1 associated with said top extremity.

* * * * *